US006383037B2

(12) United States Patent
Krause et al.

(10) Patent No.: US 6,383,037 B2
(45) Date of Patent: May 7, 2002

(54) SAFETY DISCONNECTOR

(75) Inventors: Jens Krause, Rahden; Uwe Metzing, Stemwede; Ludger Leve, Espelkamp, all of (DE)

(73) Assignee: Harting Automotive GmbH & Co., KG (DE)

( * ) Notice: Subject to any disclaimer, the term of this patent is extended or adjusted under 35 U.S.C. 154(b) by 0 days.

(21) Appl. No.: 09/760,674

(22) Filed: Jan. 16, 2001

(30) Foreign Application Priority Data

Jan. 17, 2000 (DE) ..... 100 01 631
Apr. 6, 2000 (DE) ..... 200 06 313 U

(51) Int. Cl.[7] ..... H01R 4/38
(52) U.S. Cl. ..... 439/761; 200/400
(58) Field of Search ..... 434/754, 761; 307/10.7; 200/400

(56) References Cited

U.S. PATENT DOCUMENTS 1,615,106 A * 1/1927 Bethea ..... 307/10.7
5,389,824 A 2/1995 Moroto et al.
5,894,394 A * 4/1999 Baba et al. ..... 361/87
6,020,656 A * 2/2000 FDildan ..... 307/10.7
6,078,108 A * 6/2000 Froschl ..... 307/10.7
6,111,132 A * 8/2000 Bae ..... 307/10.7

FOREIGN PATENT DOCUMENTS

DE 90 15 314 U1 3/1991
DE 197 49 896 A1 6/1999

* cited by examiner

*Primary Examiner*—Tulsidas Patel
*Assistant Examiner*—Phuong Dinh
(74) *Attorney, Agent, or Firm*—Cook, Alex, McFarron, Manzo, Cummings & Mehler, Ltd.

(57) ABSTRACT

A disconnector comprises a first conductor (10), a second conductor (14) which is mechanically connected with the first conductor (10) but electrically insulated therefrom, and a semiconductor switch (28) which provides an electrically switchable electric connection between the first and second conductors.

19 Claims, 9 Drawing Sheets

SAFETY DISCONNECTOR

The invention relates to a safety disconnector which serves for disconnecting, in case of need, the electric connection between two conductors. Such devices are used in particular in automotive engineering, e.g. to disconnect the connection to the vehicle battery in an accident so as to de-energize the electric circuits of the vehicle and reduce the danger of explosion. To this end, pyrotechnic disconnectors are known which use a pyrotechnic explosive charge which can be ignited in case of need thus disconnecting the electric connection to the vehicle battery.

It is the object of this invention to provide a disconnector which is less expensive than conventional disconnectors but still has a high degree of reliability.

According to the invention this object is achieved by a disconnector comprising a first conductor, a second conductor which is mechanically connected with the first conductor but electrically insulated therefrom, and a semiconductor switch which provides an electrically switchable electric connection between the first and second conductors. In this way, a disconnector is provided which makes do without complicated and expensive components such as a pyrotechnic explosive charge. On the one hand, the employed semiconductor switch, which may be in particular a transistor, is cost-effective and, on the other hand, it can be arranged with minor expense so as to be protected from the environmental conditions in order to achieve a high degree of reliability.

It is preferably provided that the first conductor has a receiving section which is designed in the form of a pocket and that the second conductor has a holding section which is disposed in the receiving section. This nested arrangement of first conductor and second conductor results in a high mechanical strength.

According to a preferred embodiment an insulating body is provided which is equipped with a mount for the holding section of the second conductor and is disposed within the receiving section of the first conductor. The insulating body, which consists of plastics, for example, ensures the electrical insulation between the first and second conductors, on the one hand, and guarantees the mechanically stable connection between the two conductors, on the other The insulating body and the receiving section of the first conductor are preferably provided with a recess within which the semiconductor switch is disposed. With this design the semiconductor switch can be disposed in a quasi flush manner, so that it does not protrude beyond the outer surface of the receiving section and thus cannot be damaged.

It is preferably provided that the recess is filled with a sealing compound. Due to the sealing compound the semiconductor switch is protected in optimum fashion from environmental influence, so that the functional reliability of the disconnector is ensured for a long period of time.

The semiconductor switch is preferably in thermal contact with the holding section of the second conductor. The second conductor which with respect to the current to be transmitted by it has a relatively large cross-section, ensures the dissipation of the heat generated when the semiconductor is operated, so that the operating temperature of the semiconductor switch is kept within safe limits.

According to the preferred embodiment it is provided that several shoulders are formed at the edge of the recess of the receiving section of the first conductor and that the semiconductor switch is connected to the first conductor by bond wires which lead to the shoulders. The shoulders enable the bond wires to be guided such that like the semiconductor switch they do not protrude beyond the outer contour of the disconnector. Thus, the bond wires can be fully surrounded by the sealing compound which is disposed in the recess, so that they are protected from damage.

According to the preferred embodiment a connecting plug is provided which has a locking section which extends through the receiving section and the holding section. The connecting plug has a double function: On the one hand, it enables simple connection of a control line with which the semiconductor switch can be signaled. On the other hand, it serves, because of its arrangement, as a mechanical lock which ensures a firm mounting of the components among one another in. particular in the case of tensile or pressure forces acting between the first and second conductors.

It may be provided that the receiving section and the holding section are conically tapered in the mounting direction. The conical shape facilitates the mounting and a tolerance compensation between the receiving section, the holding section and the insulating body.

The receiving section and the support section are preferably provided with mechanical locks. The mechanical locks which may be formed by embossings at the receiving section or noses at the holding section, for example, ensure in the same way as the locking section of the connecting plug a positive engagement between the first conductor, the insulating body and the second conductor, so that the mechanical fit of these components is ensured.

According to a further preferred embodiment of the invention it is provided that the second conductor has a receiving section, that the first conductor has a holding section which is disposed within the receiving section, and that both the receiving section and the holding section have two lateral webs each, which face each other in pairs at a distance and which can be electrically connected to each other by means of several semiconductor switches. In this design, the material cross-section for the current transmission between the two conductors is greater.

It is preferably provided that each lateral web of the receiving section is equipped with terminal lugs one of which is attributed in each case to a semiconductor switch. By using the terminal lugs which extend from the external lateral webs towards the interior of the disconnector, short bond wires can be used so that there is only little danger of mechanical damage.

The semiconductor switches are preferably connected in heat-conducting manner to the lateral webs of the holding section. The large material cross-section of the lateral webs ensures sufficient carrying-off of the resulting power dissipation and prevents inadmissible heat gain of the semiconductor switches.

In order to insulate the semiconductor switches, the space between the semiconductor switches is preferably filled with a sealing compound, and the lateral webs are molded with an electrically insulating material. This material also ensures the insulation between the lateral webs which face each other.

According to a further development the lateral webs are given a structural shape which together with the electrically insulating material ensures a positive engagement between connecting section and holding section. In this way it is possible to transmit reliably tensile forces acting between the first and second conductors, without damaging the disconnector.

According to a preferred embodiment the two lateral webs of the receiving section change into a battery terminal, each lateral web leading to a section of the contact ring of the battery terminal. This design is particularly advantageous because both the receiving section of the disconnector and the contact ring of the battery terminal can be made of a single sheet metal member, e.g. by stamping. Thus, the production cost is low. This design also leads to the fact that the distance between the battery terminal and the disconnector is extremely short, so that when the first conductor is switched off by means of the semiconductor switch there is no more danger that contacting of a live section results in a short circuit between the battery terminal and the disconnector.

Advantageous embodiments of the invention follow from the subclaims.

The invention is described below by means of a preferred embodiment which is shown in the appended drawings, in which.

Figure 1:
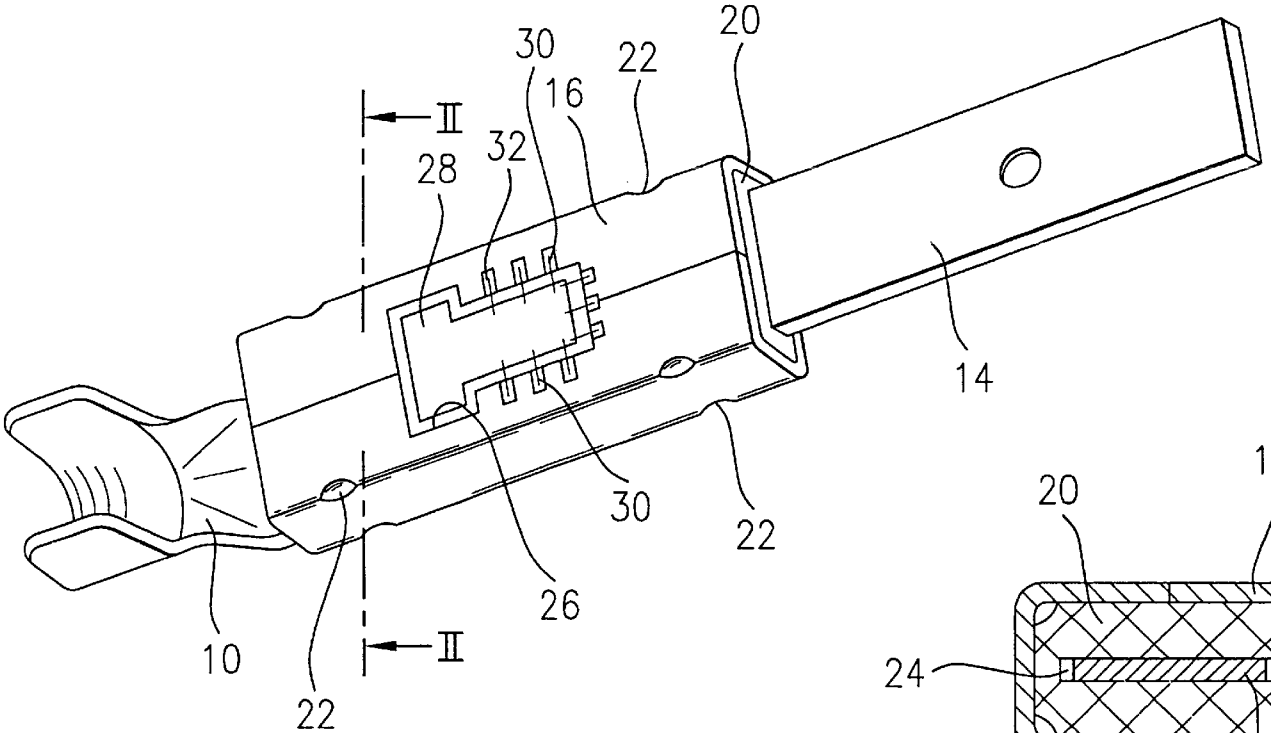
FIG. 1 shows a perspective view of a disconnector according to a first embodiment of the invention.
Figure 2:
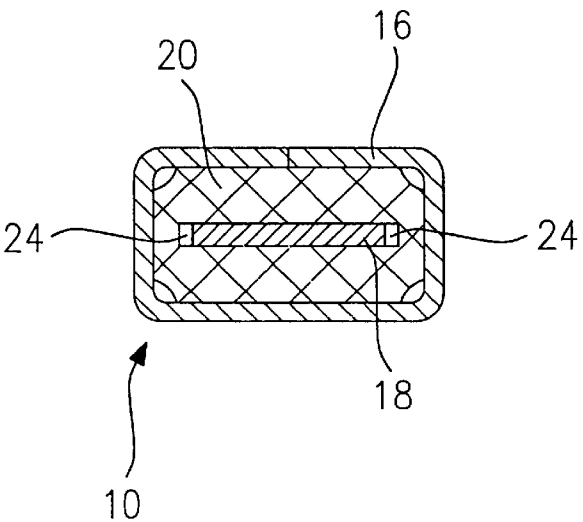
FIG. 2 shows a cross-sectional view of the disconnector of FIG. 1 along plane II—II of FIG. 1.
Figure 3:
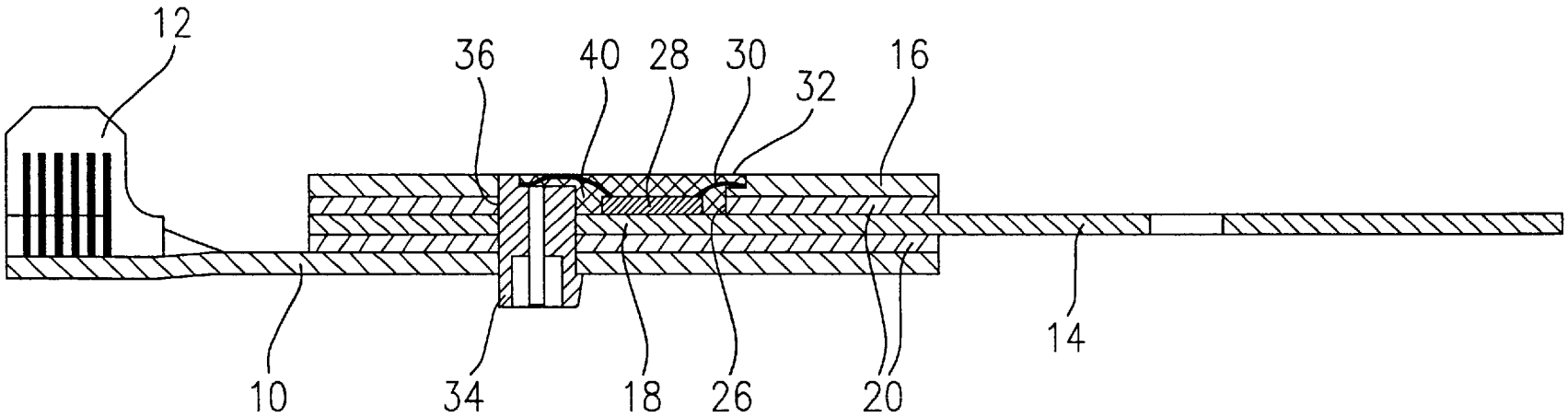
FIG. 3 shows a longitudinal section of the disconnector of FIG. 1.
Figure 4:
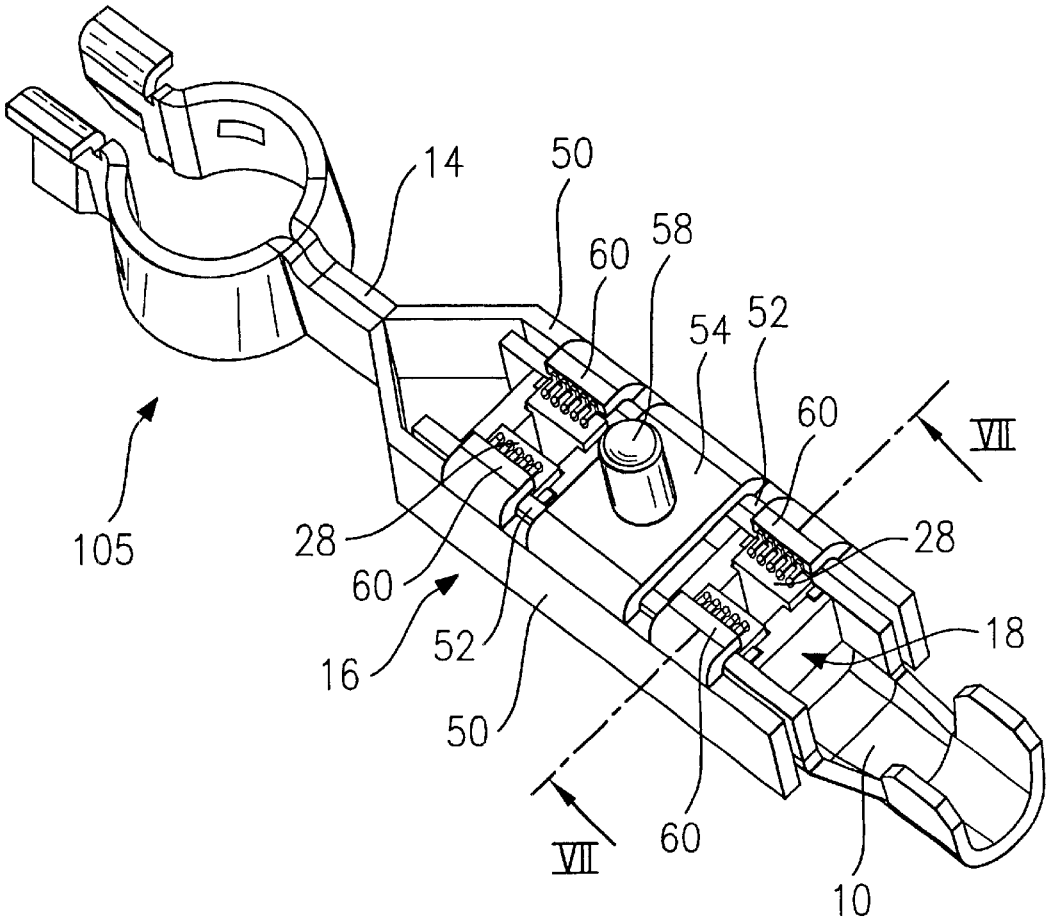
FIG. 4 shows a perspective top view of a disconnector according to a second embodiment of the invention with a battery terminal.
Figure 5:
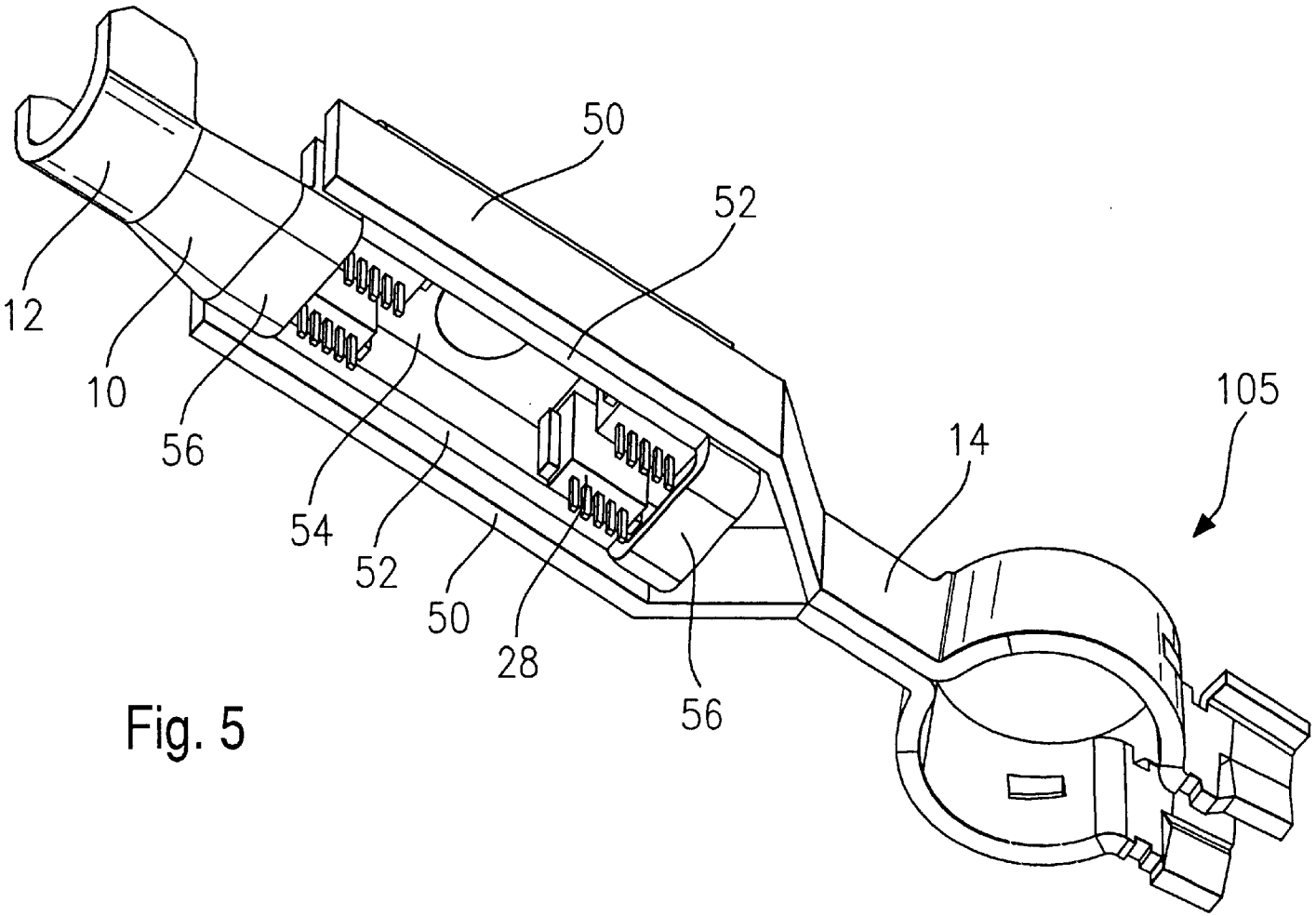
FIG. 5 shows a perspective bottom view of the disconnector of FIG. 4.
Figure 6:
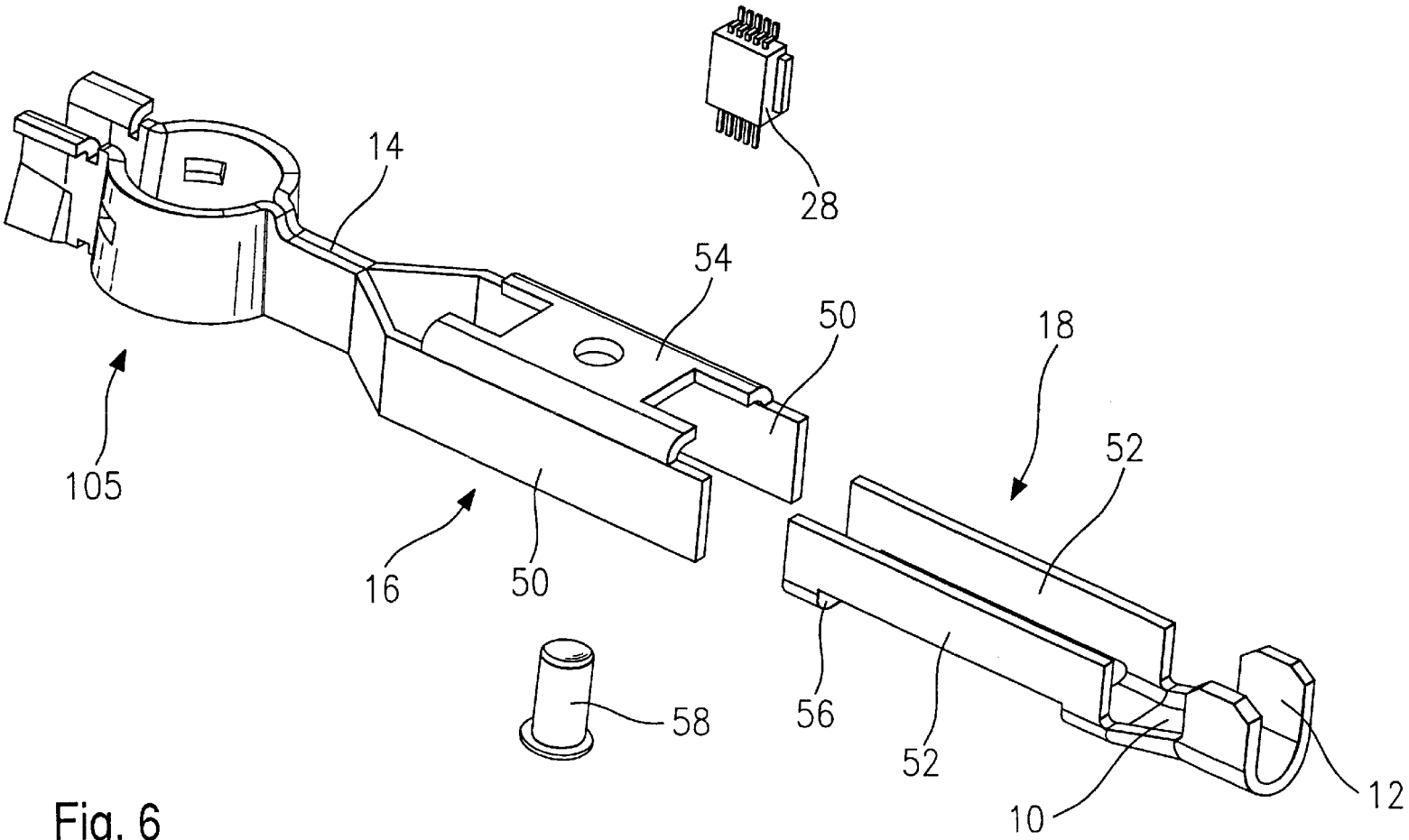
FIG. 6 shows a perspective exploded view of the disconnector of FIG. 4.
Figure 7:
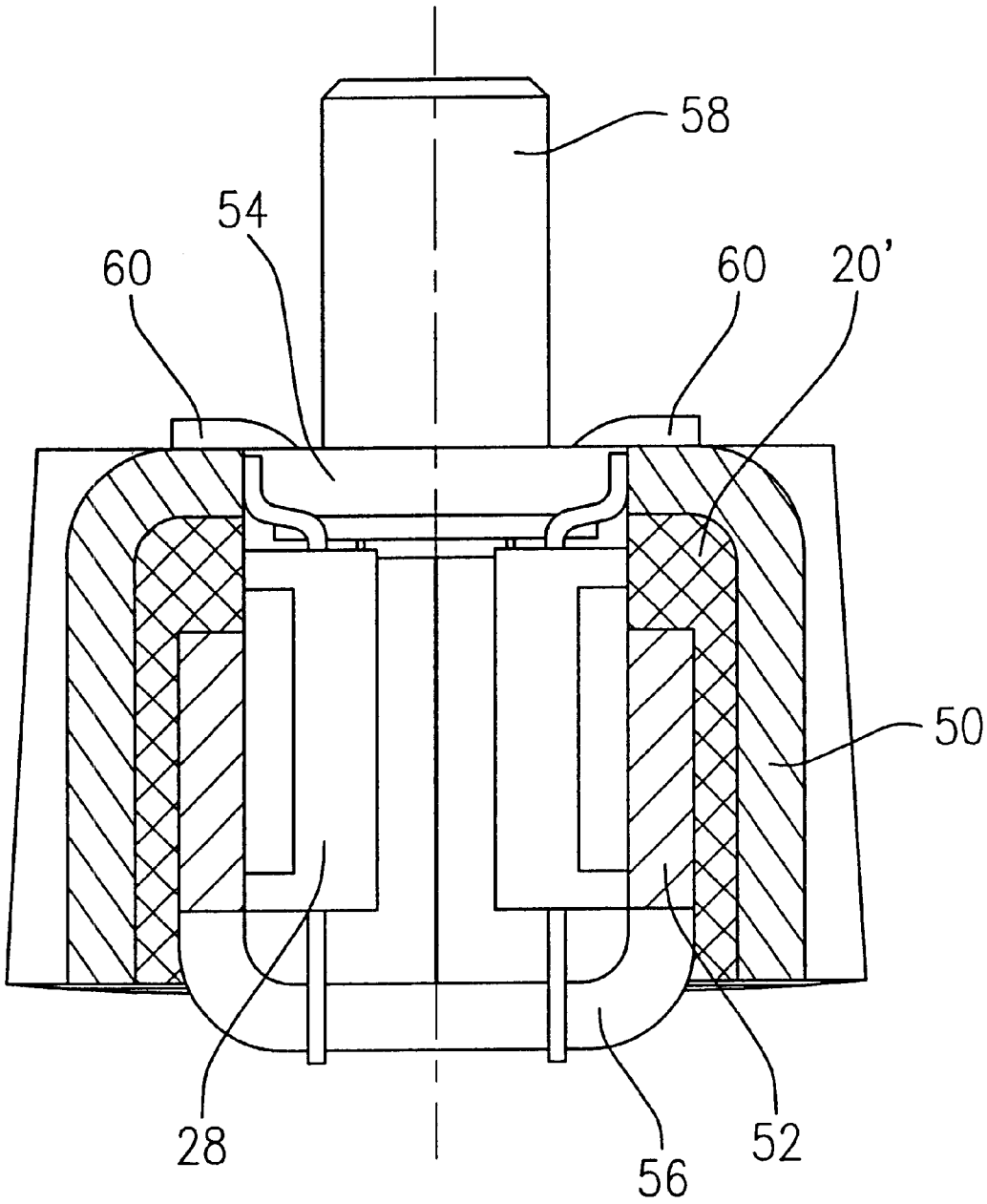
FIG. 7 shows a cross-sectional view along plane VII—VII of FIG. 4.
Figure 8:
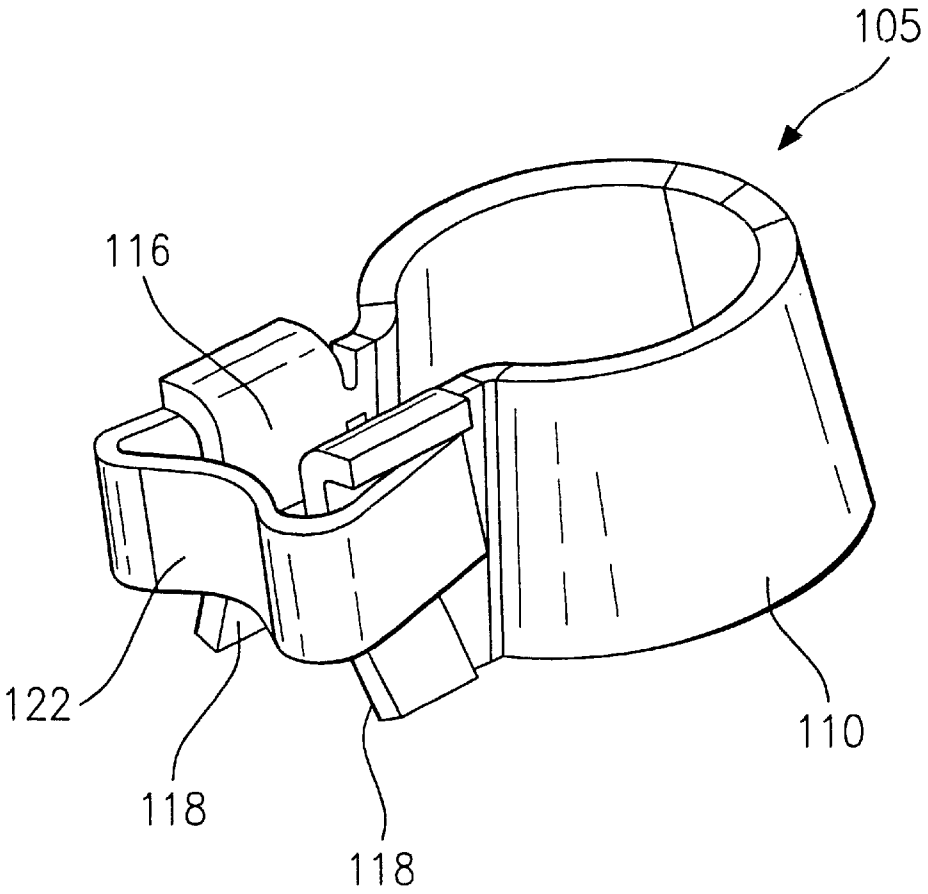
FIG. 8 shows a perspective enlarged view of the battery terminal of the disconnector illustrated in FIG. 4, some functional parts having been omitted for better comprehension.
Figure 9:
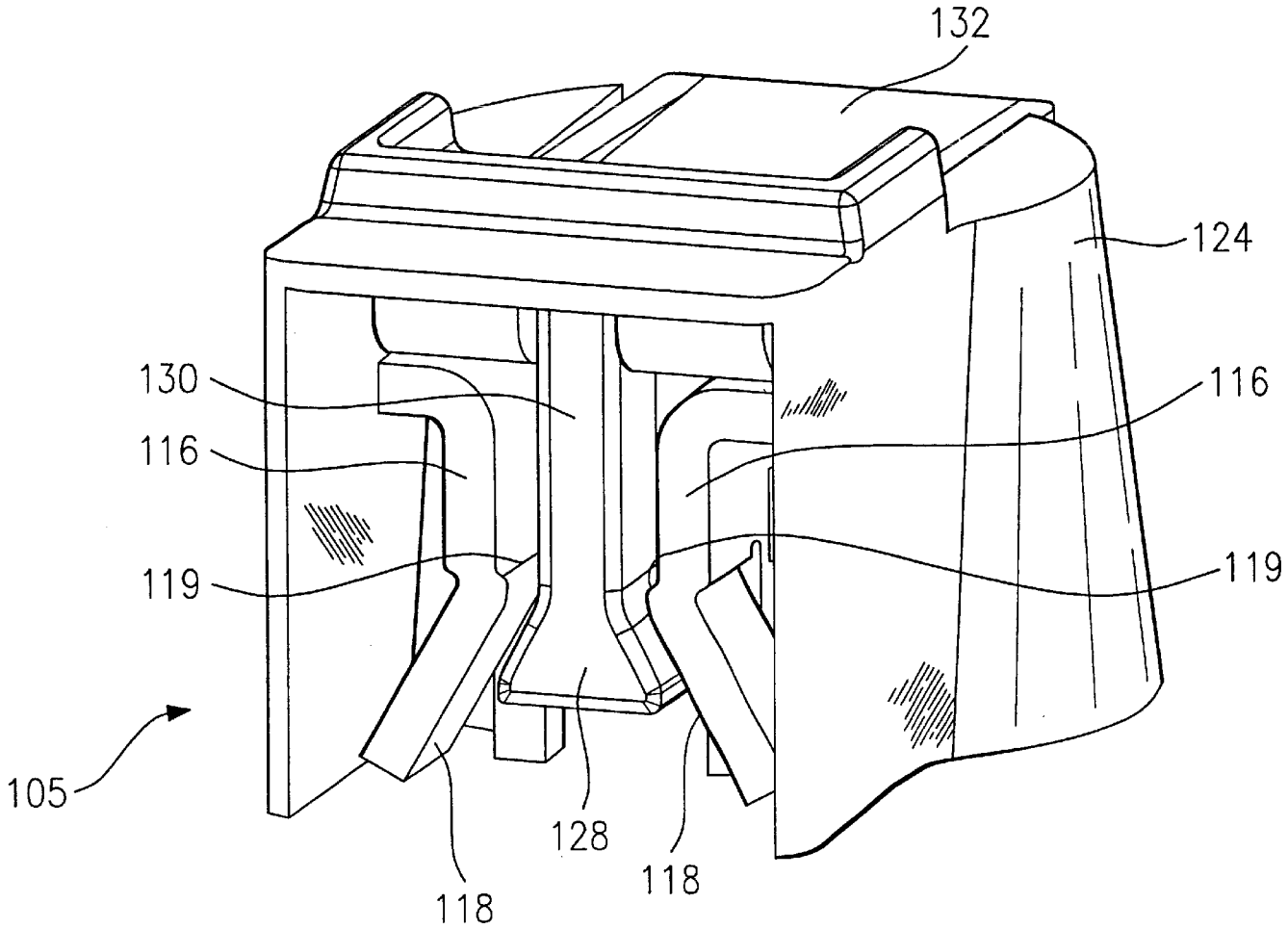
FIG. 9 shows another perspective view of the battery terminal of the disconnector illustrated in FIG. 4.
Figure 10:
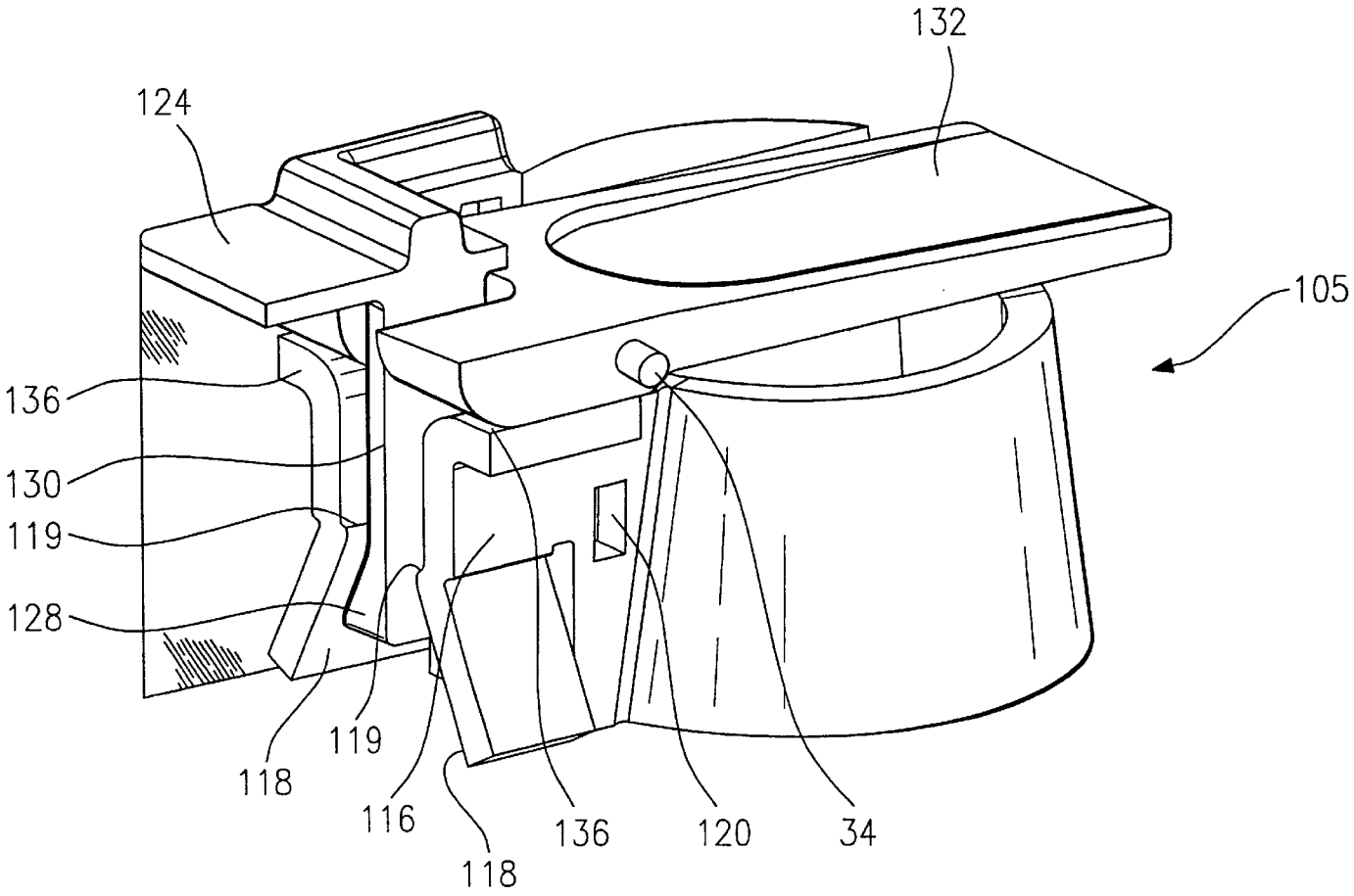
FIG. 10 shows another perspective cutaway view of the battery terminal of the disconnector illustrated in FIG. 4.

FIGS. 1 to 3 show a disconnector according to a first embodiment. It may be used in particular for connecting a vehicle battery and has a first conductor 10 which is provided with a crimp section 12 to which a cable leading to the vehicle circuit can be connected. The disconnector also comprises a second conductor 14 which can be connected to a battery terminal which can be placed on a terminal of a vehicle battery. Both conductors consist of an electrically conducting sheet metal strip.

The first conductor 10 is provided with a receiving section 16 which serves for receiving the holding section 18 of the second conductor 14. The receiving section 16 is formed integrally with the first conductor 10 by suitably bending two lugs so as to form a pocket-like hollow body which embraces the holding section 18 of the second conductor 14.

In the interior of the receiving section 16, an insulating body 20 is disposed between the first and second conductors. On its outer side, this body is adapted to the inner contour of the receiving section 16, and in its interior it is provided with a mount adapted to the holding section of the second conductor.

The receiving section embraces the insulating body which in turn surrounds the holding section in such a firm manner that the efficient frictional engagement already ensures a certain mechanical hold between the receiving section 16 of the first conductor 10, the insulating body 20 and the holding section 18 of the second conductor 14. In order to improve this mechanical mounting, mechanical locks are additionally provided which are formed by embossings 22 at the receiving section 16, on the one hand, and by noses or teeth 24 at the holding section 18 of the second conductor 14, on the other. The embossings and teeth ensure a positive engagement between receiving section, insulating body and holding section.

The receiving section 16 and the insulating body 20 are provided with a recess 26 in which a semiconductor switch 28 is disposed. The semiconductor switch is mounted with the holding section 18 of the second conductor 14 in both electrically conducting connection and well heat-conducting connection. The semiconductor switch 28 is connected in electrically conducting manner to the receiving section 16 of the first conductor 10 by bond wires 30.

At the edge of the recess 26 shoulders 32 are formed which serve for connecting the bond wires 30. As shown in FIG. 3, the bond wires 30 can be connected in this way such that they do not protrude beyond the outer contour of the receiving section 16.

In order to prevent the bond wires from tearing off, the mechanical connection between the first conductor, the insulating body and the second conductor must ensure with respect to all the loads occurring during the operation that no relative displacement may result between the components.

The disconnector is also provided with a connecting plug 34 which is equipped with a locking section 36 extending through the receiving section 16, the insulating body 20 and the holding section 18. The locking section 36 is part of the plug body and also ensures a positive mechanical connection between receiving section 16, insulating body 20 and holding section 18. The connecting plug, comprises a connecting pin 38 which is also connected to a control input of the semiconductor switch via a bond wire.

The space remaining in the recess is filled with an electrically insulating sealing compound which serves for protecting mechanically the semiconductor switch and the particularly sensitive bond wires. The sealing compound can simply be filled in the recess 26 in such an amount that it fills the recess up to the top edge thereof. In this connection, no precautions are necessary to prevent the sealing compound from flowing into regions which it shall not reach, since the edge of the recess automatically serves as a boundary.

When operated, the disconnector described can be controlled in particularly simple manner via the connecting plug. In the ordinary operating condition, the semiconductor switch enables an electric connection between the first and second conductors, so that the circuits of the vehicle can be supplied as required. In this connection, the semiconductor switch has to be designed such that the maximum power flowing through the disconnector can be transmitted without any problems. By applying a suitable potential to the control input of the semiconductor switch the electric connection to the first and second conductors can, if required, be disconnected with minimum effort.

The disconnector can also be used for switching a consumer which is connected to one of the two conductors. If the disconnector is disposed e.g. in a current path to a starter motor for an internal combustion engine, the starter motor can, if required, be switched on directly by the semiconductor switch.

FIGS. 4 to 10 show a disconnector according to a second embodiment. The same reference numbers are used for the components known from the first embodiment, and reference is made to the above explanations.

The disconnector of the second embodiment is designed such that it has a high current-carrying capacity. For this purpose, a particularly large material cross-section is available for current conduction, and four semiconductor switches are used. However, it is basically also possible to use a different number of semiconductor switches.

Receiving section 16 is formed here substantially by two lateral webs 50 between which the holding section 18 formed by two lateral webs 52 is disposed. The two lateral webs 50 of the receiving section 16 are held together by a centrally arranged connecting web 54, and the two lateral webs 52 of the receiving section 18 are held together by two connecting webs 56 disposed at the ends. Both the receiving section and the holding section are made integrally of sheet metal, e.g. by stamping.

An insulating body 20 is disposed between receiving section and holding section. This body prevents direct current flow between the receiving section and the holding section. For current transmission four semiconductor switches 28 are provided which are arranged in both electrically conducting connection and heat-conducting connection to the lateral webs 52 of the holding section 18. Good heat dissipation is ensured in this way.

The bond wires 30 of the semiconductor switches 28 are connected to the lateral ridges 50 of the receiving section by means of connection lugs 60 which starting from the lateral ridges 50 extend across the lateral ridges 52 of the support section to the corresponding semiconductor switch. In this way, the bond wires can be short, which reduces the danger of damage.

The connections of the control input of the semiconductor switches, on which a connecting plug can be put, start from the bottom side of the support section.

By suitably signaling the semiconductor switches, an electric connection can be controlled between the receiving section and the holding section and thus between the conductors 10, 14. In an electric connection, a uniform current flow results from the lateral webs and the four semiconductor switches.

The connecting web 54 of the receiving section is provided with a connection for a by-pass cable, which is here designed as a stud to which a cable lug can be connected. This enables a permanent connection, which cannot be switched by means of the semiconductor switches, to the second conductor 14.

A battery terminal 105 borders on the second conductor 14. It has as a central component a contact ring 110 which is formed by an extension of the lateral webs 50 of the receiving section 16. Thus, the contact ring of the battery terminal can be made integrally with the second conductor and the receiving section by stamping.

The contact ring 110 is made with a slot so that two opposite terminal ends 114 form each of which is provided with a lug 116. Each lug 116 is provided with a slope 118 and a recess 120. At the transition between slope 118 and lug 116, a locking edge 119 is formed which protrudes by about 0.3 to 0.5 mm.

A spring 122 engages the lugs 116 of the contact ring 110, which tries to compress the lugs 116. In order to prevent slipping of the spring 122, it is provided with two noses which engage the recesses 120 of the lugs 116.

The battery terminal is provided with a cover 124 which covers the contact ring 110 and is pivotally supported in notches 126 of the terminal lug 112. The cover 124 is provided with a blocking member in the form of a locking wedge 128 which is integrally formed on the cover 124 by a material web 130 and is disposed between the two lugs 116 of the contact ring 110, which are provided with the slopes 118.

A two-armed lever 132 is mounted on the cover 124 by means of bearing journals 134. One arm extends from the bearing journal 134 beyond the contact ring 110 while the other end of the lever 132 is supported on two supporting surfaces 136 which are formed at the lugs 116. The lever 132 is forked in this area, so that the material web 130 may extend between the two ends which rest on the supporting surfaces 136.

The locking wedge 128 may be moved together with the cover 124 between a contact position shown herein and a mounting position which is not shown in the Figures. In its contact position, the locking wedge is found in an area between the two slopes 118 in which the wedge does not contact the slopes. Thus, the two lugs 116 can be contracted by spring 122. In its mounting position, the locking wedge 128 is disposed between the two lugs 116 above the two slopes 118, it abutting against the locking edge 119 which prevents the wedge from moving unintentionally into the contact position.

The battery terminal is mounted in the following way: When delivered, the battery terminal is in its mounting position in which the locking wedge 128 moves apart or expands the two lugs 116, so that the contact ring 110 is also expanded. In this condition, the battery terminal can be put manually or by a mounting robot onto the conical battery contact to be connected. This is done by exerting a pressure force on the cover 124. The force exerted on the cover 124 is in this connection transmitted to the contact ring 110 via the notches 126, on the one hand, and via the material web 130 and the locking wedge 128 abutting against the locking edges 119, on the other. Because of the conical design of the battery contact and the contact ring abutting against it the exerted pressure force is converted into an expanding force acting upon the contact ring 110 when the contact ring is moved onto the battery contact to a corresponding extent. This expanding force widens the contact ring slightly and makes possible that the locking wedge 128 slips over the locking edge 119 under the influence of the still exerted pressure force when the lugs 116 are moved apart. The cover 124 is then farther slipped onto the contact ring 110, the locking wedge 128 being converted into its contact position in which it no longer engages the lugs 116 and the slopes 118. Then, the lugs 116 are compressed by spring 122 so that the contact ring is contracted and a uniform contact force results.

The cover is released by lifting the lever 132 at its outer free end. This effects that the cover is lifted off the contact ring 110 via the journal pins 134, a whereby the locking wedge 128 is pulled between the two slopes 118 past the locking edge 119. In this condition, the contact ring 110 is expanded again, and therefore the battery terminal can be removed from the battery contact by further pulling the lever 132.

What is claimed is:

1. A disconnector comprising a first conductor (10), a second conductor (14) which is mechanically connected with the first conductor (10) but electrically insulated therefrom, and a semiconductor switch (28) which provides an electrically switchable electric connection between the first and second conductors, characterized in that the second conductor (14) has a receiving section (16), that the first conductor (10) has a holding section (18) disposed in the receiving section (16), and that both the receiving section and the holding section have two lateral webs (50, 52) each, which face each other in pairs at a distance, the lateral webs (50) of the receiving section (16) being electrically connected to the lateral webs (52) of the holding section (18) by a plurality of semiconductor switches (28), characterized in that the receiving section (16) is provided with at least one connecting web (54) which connects the two lateral webs (50) with each other, characterize in that a connection (58) for a by-pass cable is mounted on the connecting web (54).

2. The disconnector according to claim 1, characterized in that the first conductor has a receiving section (16) which is designed in the form of a pocket and that the second conductor has a holding section (18) which is disposed in the receiving section.

3. The disconnector according to claim 2, characterized in that an insulating body (20) is provided which is equipped with a mounting for the holding section (18) of the second conductor and is disposed within the receiving section (16) of the first conductor.

4. The disconnector according to claim 3, characterized in that the insulating body and the receiving section of the first conductor are provided with a recess (26) within which the semiconductor switch (28) is disposed.

5. The disconnector according to claim 4, characterized in that the recess is filled with a sealing compound (40).

6. The disconnector according to claim 5, characterized in that the semiconductor switch (28) is in thermal contact with the holding section (18) of the second conductor.

7. The disconnector according to claim 6, characterized in that several shoulders (32) are formed at the edge of the recess (26) of the receiving section of the first conductor and that the semiconductor switch is connected to the first conductor by bond wires (30) which lead to the shoulders.

8. The disconnector according to claim 2, characterized in that a connecting plug (34) is provided which has a locking section (36) which extends through the receiving section and the holding section.

9. The disconnector according to claim 2, characterized in that the receiving section and the holding section are conically tapered in the mounting direction.

10. The disconnector according to claim 2, characterized in that the receiving section and the holding section are provided with mechanical fixing devices (22, 24).

11. The disconnector according to claim 1, characterized in that the holding section (18) has two connecting webs (56) which connect the two lateral webs (52) of the holding section with each other, and that one of the two connecting webs (56) is provided with a crimp section (12) for a cable.

12. The disconnector according to claim 1 , characterized in that each lateral web (50) of the receiving section (16) is provided with terminal lugs (60), one of which is assigned in each case to a semiconductor switch (28).

13. The disconnector according to claim 1, characterized in that the semiconductor switches (28) are connected in heat-conducting manner with the lateral webs (52) of the holding section (18).

14. The disconnector according to claim 1, characterized in that the space between the semiconductor switches (28) is filled with a sealing compound.

15. The disconnector according to claim 1, characterized in that the lateral webs (50, 52) are molded with an electrically insulating material, so that an insulating body (20') forms between the receiving section and the holding section.

16. The disconnector according to claim 15, characterized in that the lateral webs (50, 52) are given a structural shape which, together with the electrically insulating body (20'), ensures a positive engagement between conducting section (16) and holding section (18).

17. The disconnector according to claim 16, characterized in that the two lateral webs (50) of the receiving section (16) change into a battery terminal (105), each lateral web (50) leading to a section of the contact ring (110) of the battery terminal.

18. The disconnector according to claim 17, characterized in that each section is provided with a lug (116) for a spring (122) on its side facing away from the receiving section (16).

19. The disconnector according to claim 18, characterized in that each spring lug (116) is provided with a locking edge (119) for a locking wedge (128).

* * * * *